United States Patent [19]

Mundy

[11] Patent Number: 4,898,425

[45] Date of Patent: Feb. 6, 1990

[54] SEAT BELT KIT FOR WHEELCHAIRS

[76] Inventor: Philip C. Mundy, 47 Van Camp Avenue, Kitchener, Ontario, Canada, N2M 1J1

[21] Appl. No.: 372,617

[22] Filed: Jun. 28, 1989

[51] Int. Cl.[4] ..... A47C 7/00

[52] U.S. Cl. ..... 297/444; 297/231; 297/354; 297/DIG. 4

[58] Field of Search ..... 297/444, 231, 230, 383, 297/354, 460, DIG. 4

[56] References Cited

U.S. PATENT DOCUMENTS

| | | | |
|---|---|---|---|
| 1,840,275 | 1/1932 | Nuberg | 297/444 |
| 3,990,745 | 11/1976 | Rodaway | 297/444 |
| 4,647,060 | 3/1987 | Walton | 297/354 |
| 4,834,455 | 5/1989 | Proctor | 297/460 X |

*Primary Examiner*—James T. McCall

*Attorney, Agent, or Firm*—R. Craig Armstrong

[57] ABSTRACT

A wheelchair seat back kit is disclosed, including a seat back defining shell having a generally upright back portion, and two integral sides leading forward therefrom. The outside dimension between the sides is less than the clear distance between the back posts of a wheelchair. Attachment points are provided for securing the shell with respect to the back posts at upper and lower seat back attachment points, with the back of the shell positionable rearward of the plane of the back posts. Preferably, at least the lower portions of the sides of the seat back project forward sufficiently to provide lateral hip support for a user of the wheelchair, and padding is positionable on the inside of the lower portions of the sides to narrow the dimension between the lower portions as required to provide the hip support for any given user. Bracket assemblies may be used to provide different seat back positions and angles. For example, the bracket assemblies may each include a vertical seat back support plate extending rearwardly from each back post, each support plate having several upper and lower attachment points.

14 Claims, 2 Drawing Sheets

SEAT BACK KIT FOR WHEELCHAIRS

BACKGROUND OF THE INVENTION

1. Field of the Invention

This invention relates to an improved wheelchair seat back, and to a kit for replacing an existing seat back with the improved seat back.

The seat back ordinarily supplied with a wheelchair is a flexible panel of upholstered vinyl or the like, stretched between the two back posts. For many users of wheelchairs, this is either uncomfortable or unacceptable from a support viewpoint, necessitating that the seat back be replaced by a more comfortable and/or more rigid structure.

2. Description of the Prior Art

In the past, various replacement seat backs have been used to provide such improved comfort or support, most being structures which are simply positioned loosely against the existing seat back. Such an approach may be adequate in some cases, but suffers from several drawbacks. One such drawback is that if the structure has any significant thickness to it, the effective length of the wheelchair seat is shortened considerably, causing obvious problems.

In attempting to deal with this situation, it has been recognized in the past that the existing seat back could be removed and replaced by a more rigid structure. For example, brackets of various types have been used to attach rigid structures between the back posts, the brackets typically attaching the sides of the structure to the back posts.

However, there remains a need for a replacement seat back which offers improved comfort and/or support, which can readily have its design adapted to different wheelchair sizes, and which can be adjusted or repositioned from time to time as may be desired.

SUMMARY OF THE INVENTION

It is thus an object of the invention to provide an improved wheelchair seat back.

Thus in accordance with the invention there is provided a seat back kit for attaching a seat back to the back posts of a wheelchair, including a seat back defining shell having a generally upright back portion, and two integral sides leading forward therefrom. The outside dimension between the sides is less than the clear distance between the back posts of a wheelchair. Attachment means are provided for securing the shell with respect to the back posts at upper and lower seat back attachment points, with the back of the shell positionable rearward of the plane of the back posts.

Preferably, at least the lower portions of the sides of the seat back project forward sufficiently to provide lateral hip support for a user of the wheelchair, and padding is positionable on the inside of the lower portions of the sides to narrow the dimension between the lower portions as required to provide the hip support for any given user.

In the preferred embodiment, the shell can be attached at different positions and angles relative to the back posts. For example, the bracket assemblies may each include a vertical seat back support plate extending rearwardly from each back post, each support plate having several upper and lower attachment points as described in greater detail herein.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
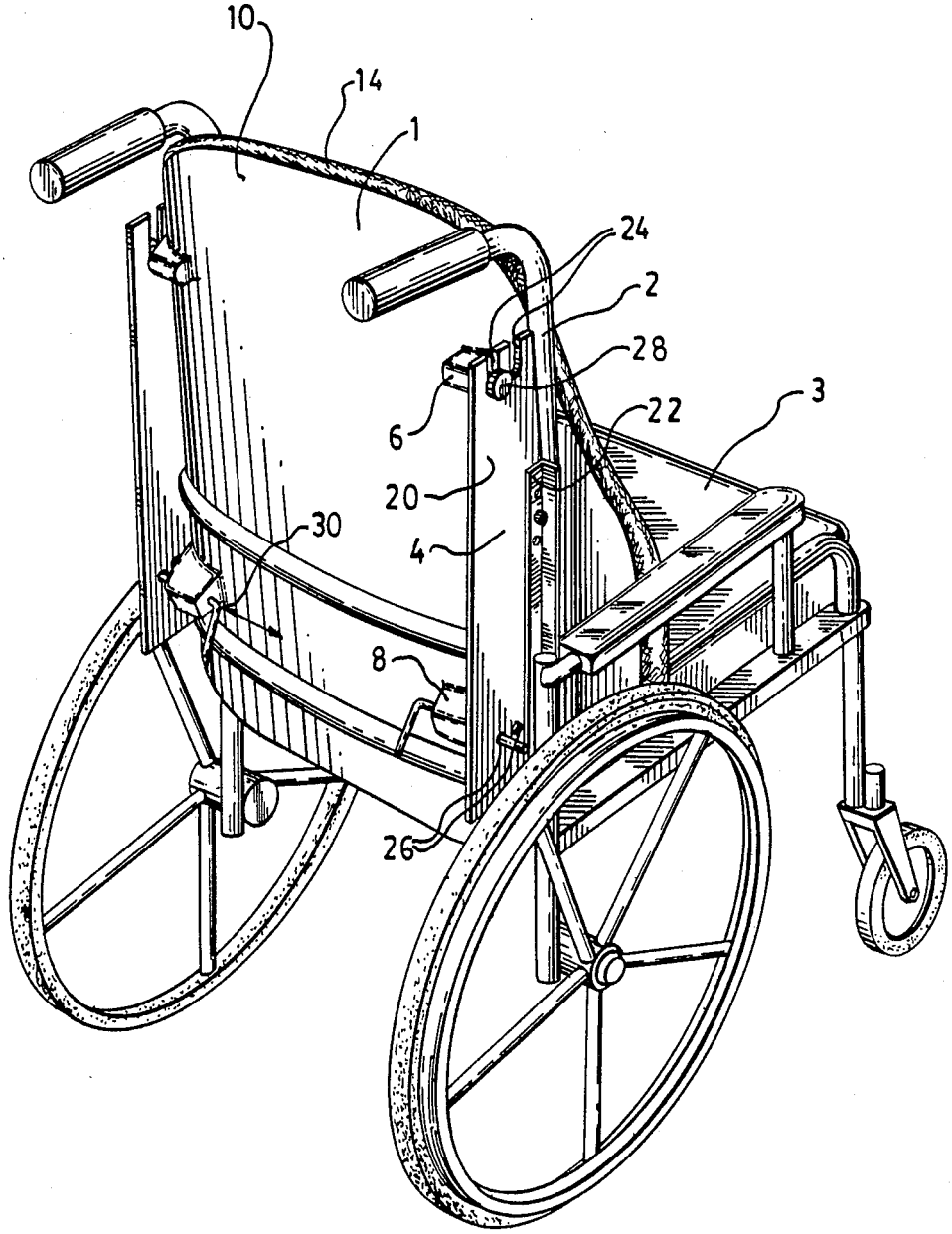
FIG. 1 is a perspective showing the invention installed on a wheelchair, as seen from a rear angle, showing the mounting of the seat back on the wheelchair back posts.

Referring to the drawings, the seat back kit is for attaching a seat back 1 to the back posts 2 of a wheelchair 3. Bracket assemblies 4 extend rearwardly from the back posts 3 and provide upper and lower seat back attachment points 6 and 8 respectively, rearward of each back post. The seat back is formed from a vacuum-molded shell 10 having a generally upright back portion 11 and two integral sides 12 leading forward therefrom. "Generally upright" is intended to mean "tending towards the vertical". As described in greater detail below, the angle of the back portion can actually be varied between approximately 0 degrees and 35 degrees back from the vertical.

The outside dimension between the sides in the region of the back posts is slightly less than the clear distance between the back posts, so that the shell can be positioned between the tubes. The shell attaches to the upper and lower seat back attachment points. Preferably and advantageously, at least the lower portions of the sides 12 project far enough forwardly to provide lateral support for the person's hips. This is an important feature which greatly improves the effectiveness of the seat back, particularly for users who require such lateral support.

Figure 2:
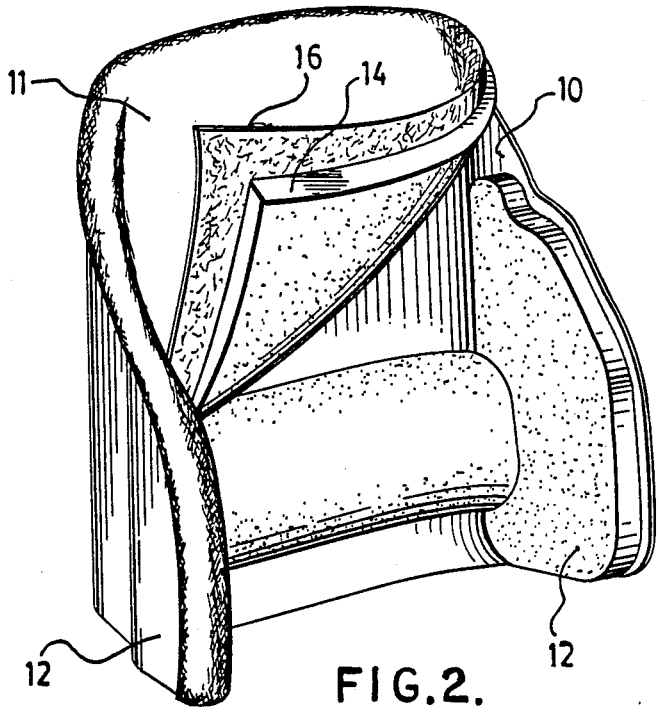
FIG. 2 is a similar perspective, from a front angle, showing the construction of the seat back itself.

Positioned to cushion the shell 10 is a one-inch thick polyfoam padding layer 14. This padding layer is covered by a removeable cover 16, shown in FIG. 2 only, having a back made of vinyl and a front of stretch cotton or the like, attached with a zipper or with Velcro (trademark) or other brand of hook and pile fastening material. The vinyl back has suitable openings for the upper and lower attachment points on each side.

Instead of the shell being cushioned in the above conventional manner, it could have special cushioning on its interior or forward-facing shape, adapted to the individual user using "foam-in-place" or similar techniques.

The shell can be attached at different positions relative to the back posts. Two bracket assemblies 4 extend rearwardly from each back post 2. In the preferred embodiment, as one of many such alternatives, each bracket assembly includes a seat support plate 20 of flat stock aluminum approximately 2 inches wide by 8 inches long by ⅛ inch thick. Rather than being attached directly to a back post 2, which would be an alternative, the support plate is attached to an L-shaped mounting bracket 22 which holds the support plate and attaches to the back post. One arm of the L-shape is adapted for attachment to a back post, having two holes which align with the holes normally found in the back posts for fastening of the conventional vinyl seat back. The other arm of the L-shape and/or the support plate have a number of holes alignable at at least two different relative positions, thereby providing vertical adjustment. That is, the support plate is fastenable to the mounting bracket at at least two different vertical locations, thereby providing vertical adjustability in the location of seat back.

Figure 3:
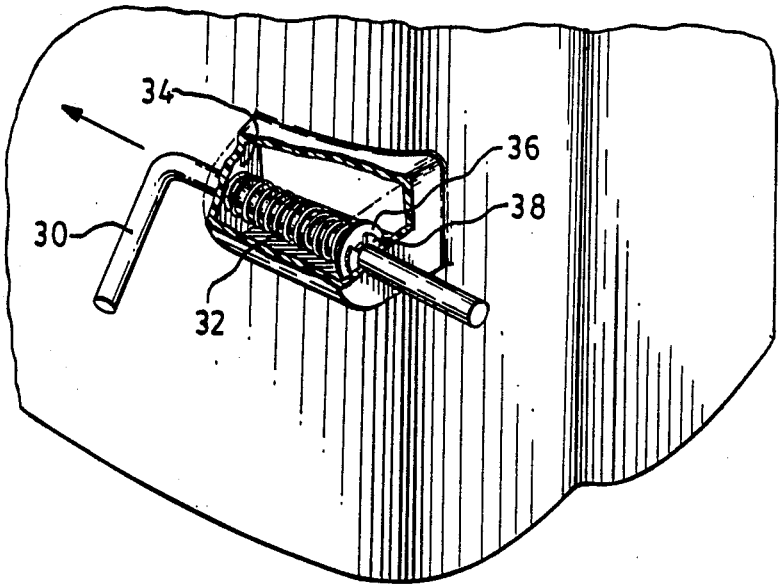
FIG. 3 is a view of one of the pins used at each lower attachment point, seen from the front of the seat back.

Each support plate 20 has two or more vertical notches 24 in the top thereof and two or more holes 26 in a horizontal row near the bottom thereof. More notches and holes could obviously be used. A stud 28 extends from the shell opposite each upper attachment point, each stud having a suitable annular recess to engage one of the notches 24. A horizontally retractable pin 30 extends from the shell opposite each lower attachment point, to move in and out of one of the holes to lock the seat back in position. As seen in FIG. 3, the retractable pin 30 is biased into the hole by virtue of a spring 32. The spring acts between the wall 34 of the cavity in the shell and a washer 36. The washer is forced to move with the pin by virtue of a retaining ring 38 which sits in an annular groove in the pin. The pin is long enough that it cannot be accidentally withdrawn far enough for it to pop out of its installed position. It can only be removed, if desired for maintenance or repair, by removing the retaining ring 38.

By virtue of the several notches 24 and holes 26, various seat back angles can be selected. In the preferred embodiment, the range is from approximately 0 degrees to 35 degrees back from the vertical. Obviously, the invention could be readily adapted to produce any other desired angles or ranges of angles.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the shell could be attached to the support plates in any number of ways other than the studs riding in notches and the retractable pins engaging in holes.

The shell itself could be provided with a plurality of holes, for even greater adjustability.

The seat back could obviously be attached directly to the back posts by any suitable arrangement of brackets, with such brackets being provided with multiple holes or other means of varying the attachment point to provide for installation of the seat back at various heights, depths and angles.

What is claimed as the invention is:

1. A seat back kit attachable to the back posts of a wheelchair, comprising:

a seat back defining shell having a generally upright back portion and two integral sides leading forward therefrom, the outside dimension between said sides being less than the clear distance between the back posts of a wheelchair;

attachment means for securing said shell with respect to said back posts at upper and lower seat back attachment points with the back of said shell positionable rearward of the plane of said back posts.

2. A seat back kit as recited in claim 1, in which said attachment means provide a plurality of upper and lower attachment points whereby the position of the seat back may be varied.

3. A seat back kit as recited in claim 1 in which at least the lower portions of said integral sides lead forward from said back portion sufficiently to provide lateral hip support for a user of the wheelchair.

4. A seat back kit as recited in claim 3, further comprising padding means positionable on the inside of said lower portions of said sides to narrow the dimension between said lower portions as required to provide said hip support for any given user.

5. A seat back kit as recited in claim 1, attachable to the back posts of a wheelchair in which said attachment means comprises bracket means extending rearwardly from each said back post and providing said upper and lower seat back attachment points rearward of the plane of said back posts, said shell being provided with means for engaging said upper and lower seat back attachment points.

6. A seat back kit as recited in claim 5, in which said upper and lower seat back attachment points and said means attached to said shell for engaging same are adapted for engagement/attachment in at least two different seat back positions.

7. A seat back kit as recited in claim 5, in which said bracket means comprises two bracket assemblies, one extending rearwardly from each said back post, each bracket assembly comprising a vertical support plate, said support plate having at least two vertical notches in the top thereof and at least two holes in a horizontal row near the bottom thereof, and in which said engagement means attached to said shell comprises a stud at each shell location corresponding to an upper attachment point, for engaging one of said notches, and a horizontally retractable pin at each shell location corresponding to a lower attachment point, for moving in and out of one of said holes.

8. A seat back kit as recited in claim 7, in which each said support plate is attached to a mounting bracket, said mounting bracket being attachable to said back post, said support plate being fastenable to said mounting bracket at at least two different vertical locations, thereby providing vertical adjustability in the location of said seat back.

9. A seat back kit as recited in claim 8, in which said mounting bracket is L-shaped, one arm of the L-shape being adapted for attachment to a back post, and the other arm of the L-shape and the support plate having a plurality of holes alignable at at least two different relative positions, thereby providing said vertical adjustability.

10. A seat back kit as recited in claim 3, attachable to the back posts of a wheelchair in which said attachment means comprises bracket means extending rearwardly from each said back post and providing said upper and lower seat back attachment points rearward of the plane of said back posts, said shell being provided with means for engaging said upper and lower seat back attachment points.

11. A seat back kit as recited in claim 10, in which said upper and lower seat back attachment points and said means attached to said shell for engaging same are adapted for engagement/attachment in at least two different seat back positions.

12. A seat back kit as recited in claim 10, in which said bracket means comprises two bracket assemblies, one extending rearwardly from each said back post, each bracket assembly comprising a vertical support plate, said support plate having at least two vertical notches in the top thereof and at least two holes in a horizontal row near the bottom thereof, and in which said engagement means attached to said shell comprises a stud at each shell location corresponding to an upper attachment point, for engaging one of said notches, and a horizontally retractable pin at each shell location corresponding to a lower attachment point, for moving in and out of one of said holes.

13. A seat back kit as recited in claim 12, in which each said support plate is attached to a mounting bracket, said mounting bracket being attachable to said back post, said support plate being fastenable to said mounting bracket at at least two different vertical locations, thereby providing vertical adjustability in the location of said seat back.

14. A seat back kit as recited in claim 13, in which said mounting bracket is L-shaped, one arm of the L-shape being adapted for attachment to a back post, and the other arm of the L-shape and the support plate having a plurality of holes alignable at at least two different relative positions, thereby providing said vertical adjustability.

* * * * *

UNITED STATES PATENT AND TRADEMARK OFFICE

CERTIFICATE OF CORRECTION

PATENT NO. : 4,898,425

DATED : February 6, 1990

INVENTOR(S) : Mundy

It is certified that error appears in the above-identified patent and that said Letters Patent is hereby corrected as shown below:

The title of the invention should read --SEAT BACK KIT FOR WHEELCHAIRS--

Signed and Sealed this

Sixteenth Day of October, 1990

*Attest:*

HARRY F. MANBECK, JR.

*Attesting Officer*

*Commissioner of Patents and Trademarks*